United States Patent [19]

Smith et al.

[11] Patent Number: 4,674,602

[45] Date of Patent: Jun. 23, 1987

[54] ARTICLE STORAGE SYSTEM

[76] Inventors: Wayne D. Smith; Bradley C. Smith, 6017 122nd S.W., both of Tacoma, Wash. 98499

[21] Appl. No.: 816,286

[22] Filed: Jan. 6, 1986

[51] Int. Cl.[4] ..... B66B 11/06; E04H 6/14

[52] U.S. Cl. ..... 187/20; 187/27; 187/16; 414/251; 254/286; 254/338

[58] Field of Search ..... 414/242, 233, 249–251, 414/248; 187/16, 27, 20, 22; 254/286, 338, 385

[56] References Cited

U.S. PATENT DOCUMENTS

| | | | |
|---|---|---|---|
| 112,573 | 3/1871 | Favor | 187/16 |
| 581,803 | 5/1897 | Armstrong | 414/251 |
| 664,041 | 12/1900 | Hadfield | 187/22 |
| 1,668,337 | 5/1928 | Ross et al. | 414/251 |
| 1,819,513 | 8/1931 | James | 414/248 |
| 2,214,139 | 9/1940 | Lindquist | 187/1 A |
| 3,077,994 | 2/1963 | Foster | 414/250 |
| 4,566,561 | 1/1986 | Atkey | 187/27 X |

FOREIGN PATENT DOCUMENTS

| | | | |
|---|---|---|---|
| 244537 | 1/1966 | Austria | 187/20 |

*Primary Examiner*—Joseph J. Rolla
*Assistant Examiner*—Nils E. Pedersen
*Attorney, Agent, or Firm*—Delbert J. Barnard

[57] ABSTRACT

A pair of wheel assemblies (26, 28) are vertically spaced apart and are supported for rotation about parallel axis (30, 38) by a common support frame (10). Each wheel assembly (26, 28) comprises a pair of wheels at its ends (38, 40). The wheels (34, 40) have radially outwardly opening channel portions (80) in which traveling bearing pads (64, 66) are received. The bearing pads are secured to endless support cables (46), and also to the end portions (152) of carrier beams (150, 194) which extend between the two wheels (34 or 40) of each assembly (26, 28). The carrier beam (150, 194) is an upper portion of a carrier (48, 48', 176) onto which is placed a motor vehicle or some article which is to be stored. A first drive cable section (54) is connected to the support cable (46) and extends therefrom to a winch drum (50). A second drive cable section (58) extends from the support cable (46) in the opposite direction to the same winch drum (50). When the winch drum (50) is rotated in one direction, it pulls on one of the drive cable sections (54, 58), and the second drive cable section (54, 58) is unwound from the winch drum (50). When the direction of rotation of the winch drum (50) is reversed, the first drive cable section (54, 58) is paid off of the winch drum (50) and the second drive cable section (54, 58) is wrapped onto the winch drum (50).

27 Claims, 17 Drawing Figures

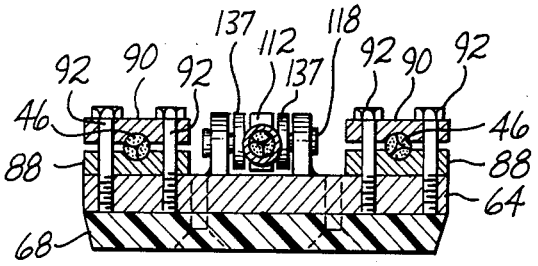
Fig.10
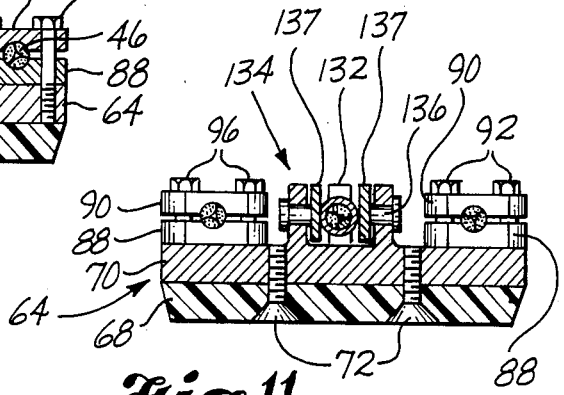
Fig.11
Fig.12
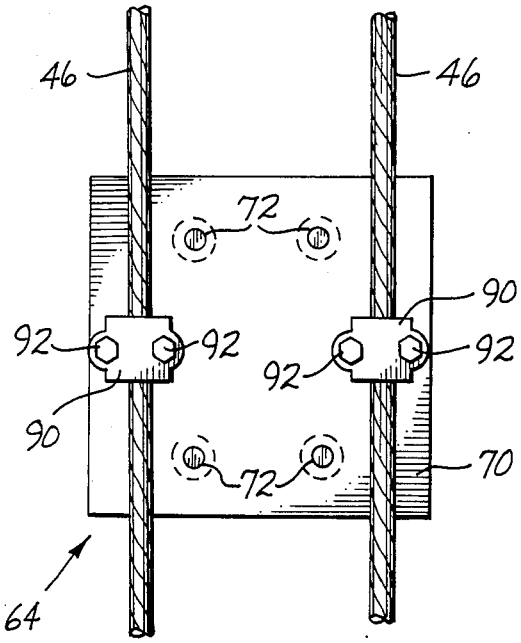
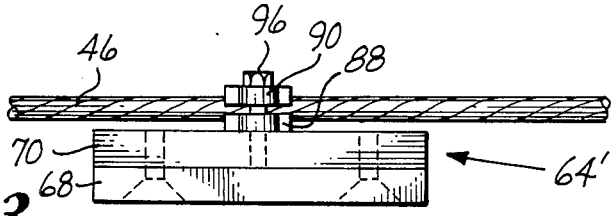
Fig.13

ARTICLE STORAGE SYSTEM

DESCRIPTION

1. Technical Field

The present invention relates to the provision of an improved article storage system of the general type disclosed, for example, by U.S. Pat. No. 2,787,387, issued Apr. 2, 1957, to E. J. Scott. More particularly, the invention relates to the provision of a low-cost system for supporting and moving the carriers for the articles to be stored.

2. Background Art

Others have recognized a need for providing vertical storage of vehicles and other articles rapidly and economically in areas where real estate value is high and/or ground level space is limited. One type of system that has been proposed may be generally referred to as a "Ferris Wheel" system in that the articles to be stored are placed on carriers that are picked up and rotated in a manner similar to the way ferris wheel seats are handled. Examples of this type of system in the patent literature are disclosed by the following U.S. Pat. Nos.: 1,834,385, granted Dec. 1, 1931, to Gilbert Currie; 1,867,675, granted July 19, 1932, to Earl O. McHenry and Frank A. McHenry; 1,800,059, granted Apr. 7, 1931 to Matthew M. Eagan; 2,738,885, granted Mar. 20, 1956, to Donald R. Demaline; 2,787,387, granted Apr. 2, 1957, to Pete J. Scott; 2,792,105, granted May 14, 1957, to Reginald D. Wilson; 2,817,446, granted Dec. 24, 1957, to Frank Hodous; 2,838,187, granted June 10, 1958, to Josef Schulte; 3,153,488, granted Oct. 20, 1964, to Kyosuke Mori; and 3,269,569, granted Aug. 30, 1966, to Shlomo Brauner.

The preferred embodiment of the present invention is more like the type of system disclosed by U.S. Pat. Nos. 1,834,385; 2,787,387; and 2,817,446. Such system comprises a lower wheel assembly and an upper wheel assembly about which endless support members extend and to which carriers for the articles to be stored are connected. This construction can provide a storage facility which is only slightly wider than two of the carriers and which can be extended vertically a considerable distance.

The systems disclosed by U.S. Pat. Nos. 1,834,385; 2,787,387; and 2,817,446 all utilize endless chains for moving the article carriers around the two wheels. The use of chains, and sprocket-type gearing made necessary by the chains, makes the system costly to build and the maintenance costs of the chain and gearing are high.

A principal object of the present invention is to provide a storage system of the general type shown by U.S. Pat. Nos. 1,834,385; 2,787,387; and 2,817,446 but which includes a unique cable support and drive system which is economical to both build and maintain.

DISCLOSURE OF THE INVENTION

The article stoarge system of the present invention is basically characterized by article carrier means secured to and supported by endless support cables which are guided for endless travel between different vertical levels. The endless support cables are used in place of chains. Compared to chain cable is cheaper, stronger, easier to maintain and quieter.

In preferred form, the endless cable is supported and guided for endless travel within a plane, between different vertical levels. Also in preferred form, the article carrier means is secured to the endless cable. A drive drum is spaced from the endless cable and is located substantially within the same plane as the endless cable. Reversible drive means is provided for the drive drum. A first drive cable section having a first end is connected to the drive drum. The first drive cable section extends in a first direction from the drive drum to the support cable. The first drive cable section has a second end which is connected to the support cable. A second drive cable section is connected at a first end to the drive drum. The second drive cable section extends from the drive drum to the support cable in the opposite direction from the first drive cable section. The second drive cable section has a second end connected to the support cable. The two drive cable sections are connected to the support cable at locations such that rotation of the drive drum in one direction will wrap the first drive cable section onto the drive drum in such a way that the first drive cable section will pull on the support cable and move it and the article carrier in one direction around said means for supporting and guiding the support cable. At the same time the second drive cable section will be unwrapped from the drive drum. A reverse rotation of the drive drum will cause the second drive cable section to be wrapped onto the drive drum, causing said second drive cable section to pull on the support cable to move it and the article-supporting carrier means in a reverse direction. At the same time the first drive cable section is being unwrapped from the drive drum.

In preferred form, the support cable includes a plurality of bearing pads spaced along its length. The bearing pads include low friction material which makes contact with the means for supporting and guiding support cable.

In preferred form, the means for supporting and guiding the support cable has a radially outwardly open channel portion into which the support cable is received. Bearing pads are connected to the support cable. The bearing pads include a low friction material which makes contact with the base of the outwardly open channel. The low friction material keeps the support cable from tracking sideways out from the channel.

In preferred form, the means for supporting and guiding the support cable comprises first and second wheels which are vertically spaced apart within a common plane. The endless support cable makes contact with peripheral portions of the wheels.

In accordance with yet another aspect of the invention, the article storage system is used for storing motor vehicles. In such a system, the carrier may be adapted to permit an automobile to drive onto or off from it from one end of the carrier. Or, the carrier may be adapted to receive a plurality of automobiles, driven onto and off from it from one side of the carrier. In either case, the carrier may have a support base portion which includes a plurality of spaced apart tubes at one end of the carrier. The wheels at one end of the vehicle are received between an adjacent pair of the tubes. This cradling of the wheels between the tubes helps secure the vehicle on the carrier. A plurality of tubes are provided so that different pairs of the tubes can be used for different length vehicles.

Additional and more detailed aspects of the invention are hereinafter described with respect to the best mode for carrying out the invention.

BRIEF DESCRIPTION OF THE DRAWINGS

In the drawings, like element designations refer to like parts throughout the several views and:

FIG. 10 is a cross-sectional view taken through a bearing pad in the vicinity of a set of cable clamps, such view being taken substantially along 8—8 of FIG. 4;

FIG. 11 is another sectional view taken through the bearing pad, such view being taken substantially along line 9—9 of FIG. 4;

FIG. 12 is a top plan view of an intermediate bearing pad;

FIG. 13 is a side elevation view of an intermediate bearing pad;

BEST MODE FOR CARRYING OUT THE INVENTION

One immediate need for an article storage system constructed in accordance with the present invention is for the storage of automobile sized motor vehicles. Accordingly, a vehicle storage system is herein illustrated and described.

The particular vehicle storage system that is illustrated and described is only an example of the invention, but it is also the best known mode of the invention.

Figure 2:
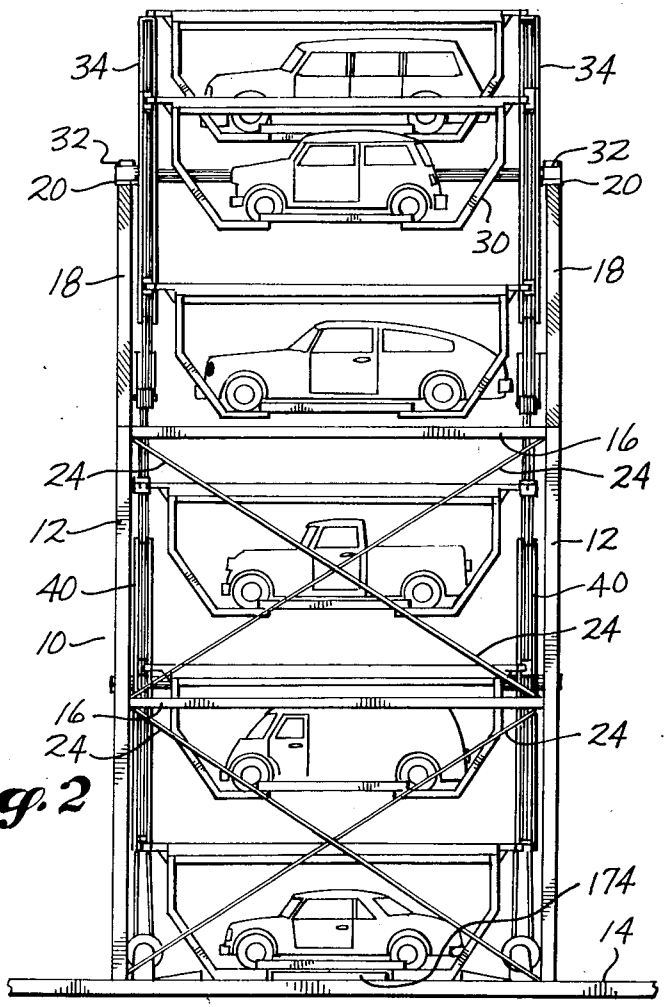
FIG. 2 is a second side elevational view looking towards the right side of the system as pictured in FIG. 1.
Figure 1:
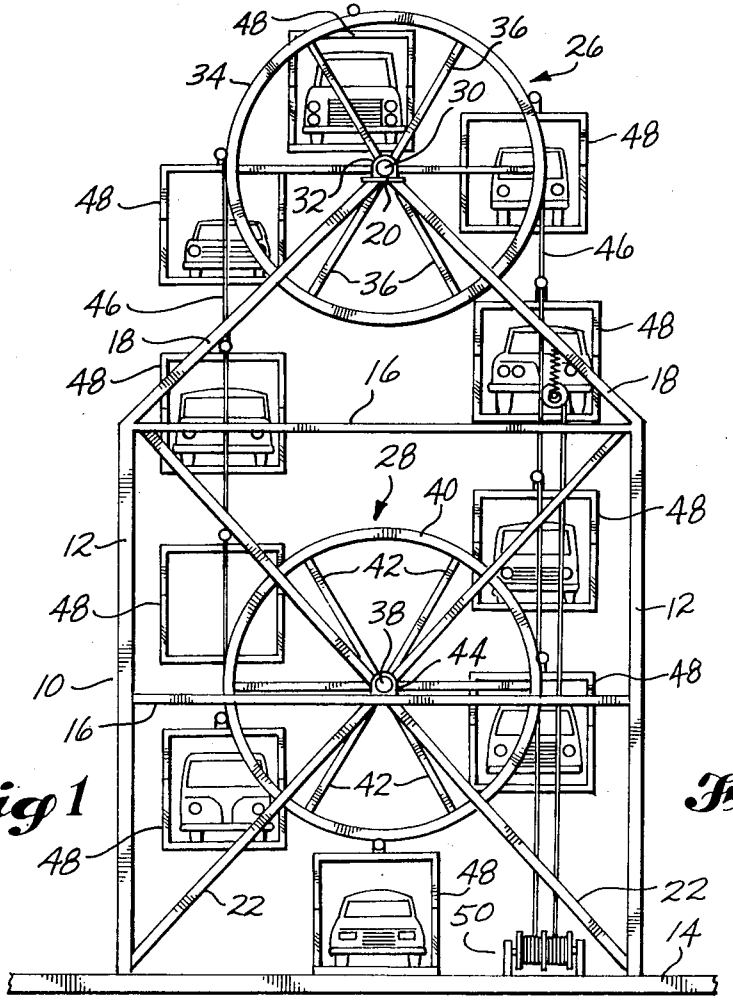
FIG. 1 is a first side elevational view of a two-wheel embodiment of the invention especially adapted for storage of automobile size motor vehicles.

Referring to FIGS. 1 and 2, the illustrated system comprises a frame 10 composed of corner located columns 12, extending upwardly from a base 14. Horizontal beams 16 may extend between the columns 12, on all four sides of the frame 10. The side of the frame 10 shown in the foreground in FIG. 1, and the opposite side of the frame 10, may include a pair of top beams 18 which extend diagonally upwardly from the upper ends of the columns 12 to an apex 20 where they are joined together. These same two side sections of the frame 10 may each also include a pair of diagonal beams 22, each of which extends from a lower corner of the frame 10, up and over to an opposite upper corner. The side section of the frame 10 shown in the foreground of FIG. 2, and the opposite side section, may be braced by diagonal frame members 24, in the manner illustrated. That is, on each such side of the frame 10, a first pair of diagonal members 24 may extend between locations at or near the lower ends of the columns 12 up and over to where the lower horizontal member 16 is connected to the opposite column 12. The upper set of diagonal members 24 may each extend from an end location of the lower horizontal member 16 up and over to the location of connection of the opposite end of the upper horizontal member 16 with the opposite column 18.

Of course, it is to be realized that the frame construction can be changed substantially from one installation to another, and the illustrated frame construction 10 is being presented by way of example only.

The system of the invention comprises a support system for the article carriers that uses cables, not chains. Means is provided on opposite sides of the frame for supporting and guiding endless cable members for endless travel within a plane, between different vertical levels.

In the illustrated embodiment, the support means for the cables is in the nature of a pair of vertically spaced apart wheel assemblies 26, 28. FIG. 1 is looking endwise of the axis of rotation of the wheels 26, 28.

Wheel assembly 26 is shown to include a center shaft 30 which extends from one apex 20 to the other. The ends of shaft 30 are received in bearings 32 provided at the apexes 20. Wheel assembly 26 further includes two ring beams 34 which are connected to end portions of the center shaft 30 by radial spokes 36.

In similar fashion, the lower wheel 28 includes a center shaft 38, a pair of ring beams 40 connected to end portions of the shaft 38, spokes 42 extending between the shaft 38 and the ring beams 40. The opposite ends of the shaft 36 are received within bearings 44 which are located where the diagonal ring members 22 intersect each other.

Each wheel assembly 26, 28 is capable of free rotation about the axis of its shaft 30, 38. As will hereinafter be described, the wheel assemblies 26, 28 are not directly driven. They are indirectly driven by the travel of carrier cables 46.

In preferred form, a pair of support or carrier cables 46 are provided on each of the two opposite sides of the system which include the ring beams 34, 40 at the ends of the wheel assemblies 26, 28. Each individual support cable is an endless member which at spaced apart locations is connected to bearing pads which during endless travel of the support cable 46 make passing contact with peripheral portions of the ring beams 34, 40. Opposite end portions of a plurality of article carriers 48 are connected to the carrier cables 46. As will hereinafter be described, the carriers 48 are connected at upper center locations to the support cables 46, by a pivotal connection, so that as the carriers 48 are moved along the paths of travel of the support cables 46, by movement of the support cables 46, gravity forces will always maintain them in a substantially plumb attitude.

Figure 3:
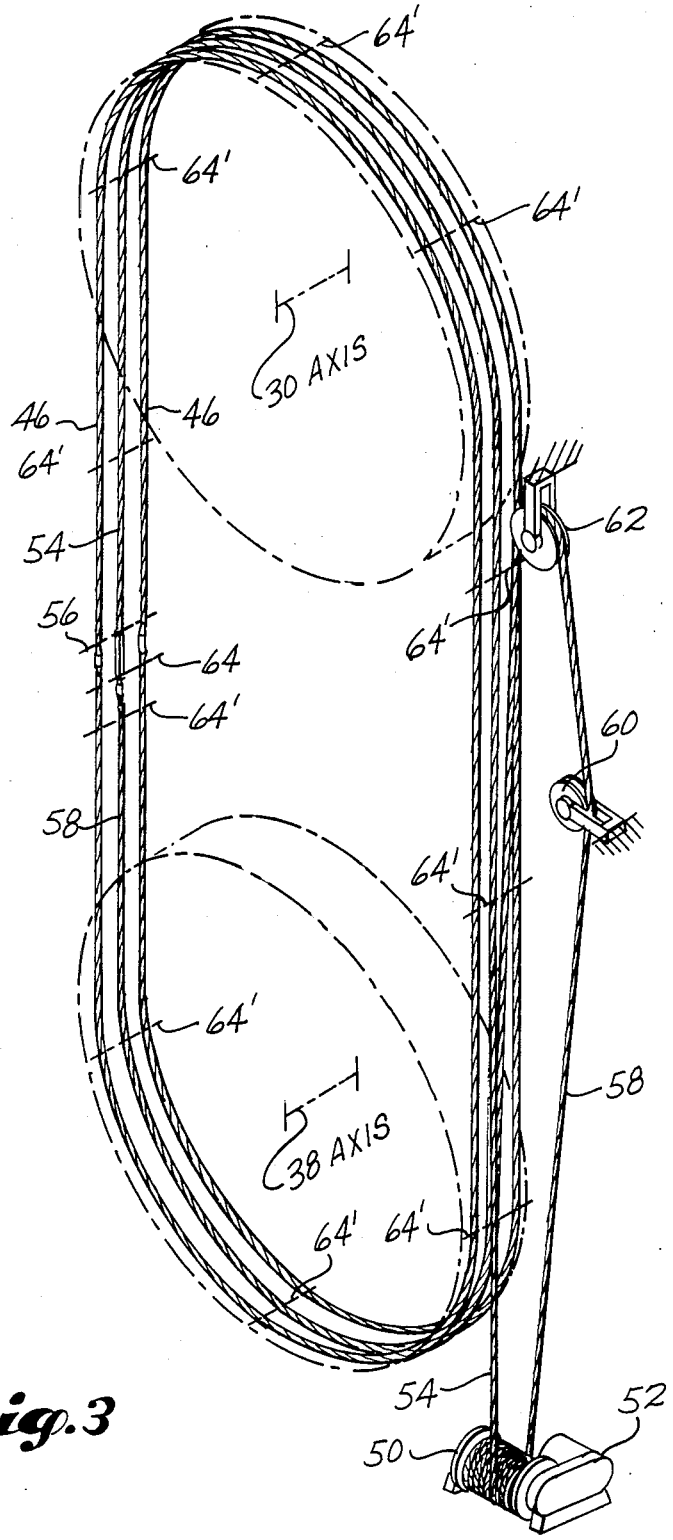
FIG. 3 is an isometric space diagram of a support and drive cable portion of the embodiment formed by FIGS. 1 and 2, with substantial detail omitted.

FIG. 3 is an isometric space diagram of an embodiment of a support cable and drive cable system which is provided at each end of each wheel 26, 28. Referring to FIG. 3, the system comprises a pair of spaced apart support cables 46, each of which is an endless cable which travels a vertically elongated oblong path comprising upper and lower semicircular runs, established by the ring beams 34, 40, and opposite side straight runs extending vertically between the contact regions of the ring beams 34, 40.

In FIG. 3 the axis of rotation of the upper wheel 26 which is also the geometrical center line of the center shaft 30, is denoted "30 axis." In similar fashion, the axis of rotation of the lower wheel assembly 28 is designated "38 axis." As will hereinafter be described, in preferred form, during use of the system, the support cables 46 are pulled along the oblong path, in either one direction or the other. The drive system for moving the support cables 46, and the article carriers 48 connected to and carried thereby, will now be described.

Referring to FIG. 3, the drive system preferably comprises a separate winch drum 50 for each path mounted on the base 14. A drive motor 52 is connected to the winch drum 50 in a manner making it possible to rotate the winch drum 50 in either direction of rotation. A first drive cable section 54 is shown to extend upwardly from the winch drum 50, between and in conjunction with the two support cables 46, to a location of connection to a bearing pad, the location of which is designated 56. A second drive cable section 58 extends upwardly from the winch drum 50 and first makes contact with the grooved periphery of a first idler wheel 60, which is suitably biased for maintaining tension in the drive cable section 58, and then extends up and over a second idler wheel 62. Idler wheel 62 is provided for changing the direction of the drive cable section 58. Idler wheel 62 includes a grooved periphery in which the drive cable section 58 is received. The drive cable section 58 extends up and over the idler wheel 62 and then downwardly, generally between and generally in conjunction with the support cables 46, to a location of connection with a bearing pad, the location of which is designated 64. Additional bearing pads 64' are provided at spaced intervals around the cables 46 (FIGS. 3, 12 and 13).

The winch ends of the drive cable sections 54, 58 are connected to the winch drum 50. The cable sections wrap onto the winch drum 50 in opposite directions. Thus, rotation of the winch drum 50 in one direction will cause one of the drive cable sections 54, 58 to be wound onto the winch drum 50, and at the same time will pay out or unwind the other drive cable section 54, 58 off from the winch drum 50. Referring to FIG. 3, when the winch drum 50 is driven in a direction causing the drive cable section 54 to be wound onto the winch drum 50, such drive cable section 54 will exert a pulling force on bearing pad 56 which will be transmitted to the two support cables 46, causing endless travel of the support cables 46 in a clockwise direction. This rotation of the winch drum 50 will pay out the drive cable section 58, allowing it to move with the support cables 46. When the drive of the winch drum 50 is reversed, drive cable section 58 is wound onto the winch drum 50 and exerts a pulling force on bearing pad 64, causing its movement and movement of the support cables 46 in a counterclockwise direction. At the same time the drive cable section 54 is being paid out from the winch drum 50, allowing it to be moved with the moving support cables 46.

Referring to FIGS. 4–6, 10 and 11, the bearing pads 56, 64, 66 are basically the same in construction. Each comprises a metal plate body 70 to which blocks of a self-lubricated bearing material (e.g. the product identified by the trademark "TEFLON") are secured. As shown by FIG. 11, which is a sectional view through bearing pad 64, the self-lubricated plastic material 68 may be fastened to the metal plate body 70 by means of countersunk machine screws 72 which extend through the plastic material 68 and thread into threaded openings in the metal body 70. The self-lubricated plastic members (e.g. members 68) are directed inwardly so that they will contact the peripheral portions of the ring beams 34, 40.

Figures 7, 8, 9:
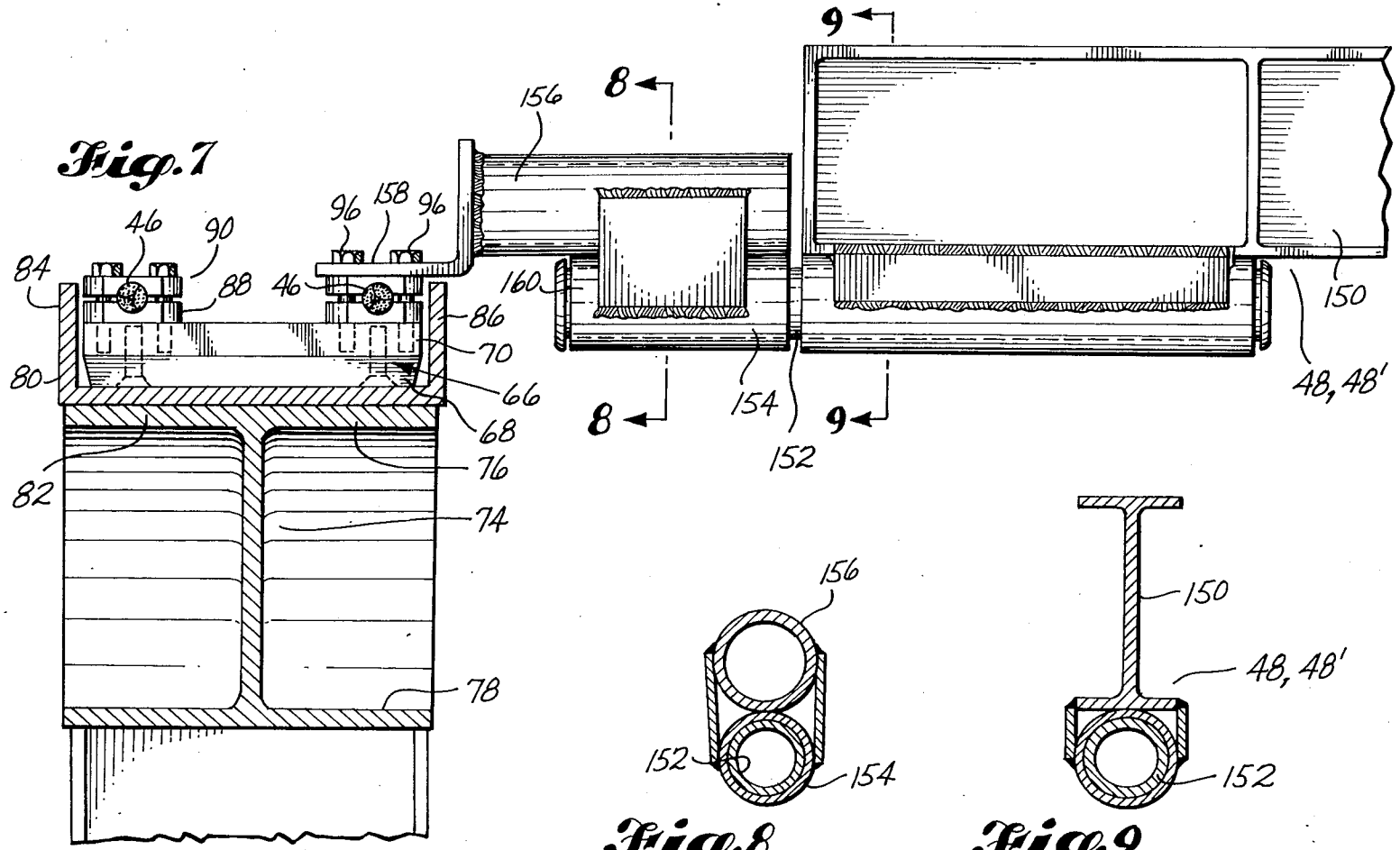
FIG. 7 is an enlarged scale detail view, taken at one end of an embodiment of an article carrier, showing the support wheel for the cable system in section, and showing an end view of a bearing pad, and further showing cable clamps and an end portion of a support shaft for the article carrier in side elevation.
FIG. 8 is a cross-sectional view taken substantially along line 8—8 of FIG. 7.
FIG. 9 is a cross-sectional view taken substantially along line 9—9 of FIG. 7.

FIG. 7 shows a typical construction of the ring beams 34, 40. A wide flange beam 74 is rolled in a circle, with one of its flanges 76 being on the outside of the circle and its second flange 78 being at the inside of the circle. A channel member 80 is also rolled in a circle, with its open side directed outwardly and its web side directed inwardly. The web 82 is then welded or otherwise firmly secured to the flange 76, so that the rolled channel 80 and the rolled wide flange beam 78 together constitute the ring beam 34, 40. As shown in FIG. 7, the outwardly directed surface of the web 82 of the channel member 80 defines the peripheral surface which makes contact with the self-lubricated plastic material 68. The flanges 84, 86 function as side retainers, for preventing the bearing pads 56, 64, 66 from sliding sideways off of the peripheral surfaces of the ring beams 34, 40.

In preferred form, the support cables 46 are secured to the metal body portions 70 of the pad bearings by means of clamp structures which include inner and outer clamp members 88, 90. Each clamp member includes a generally semi-cylindrical groove, for receiving a side portion of the cable, and a pair of bolt receiving openings, one on each side of the groove. The groove is sculptured to include ribs which extend into the grooves defined between adjacent strands of the cable. As shown by FIG. 10, the bolts 92 extend through the openings in the clamp members 88, 90 and at their inner ends 94 thread into threaded openings formed in the metal members 66. A head 96 at the outer end of each bolt 92 bears against the outer clamp member 90, so that tightening of the bolts 92 will draw the two clamp members 88, 90 tightly together about the cable 46, as well as securing the clamp members 88, 90 and the cable 46 to the metal plate 70.

Figures 4, 5, 6:
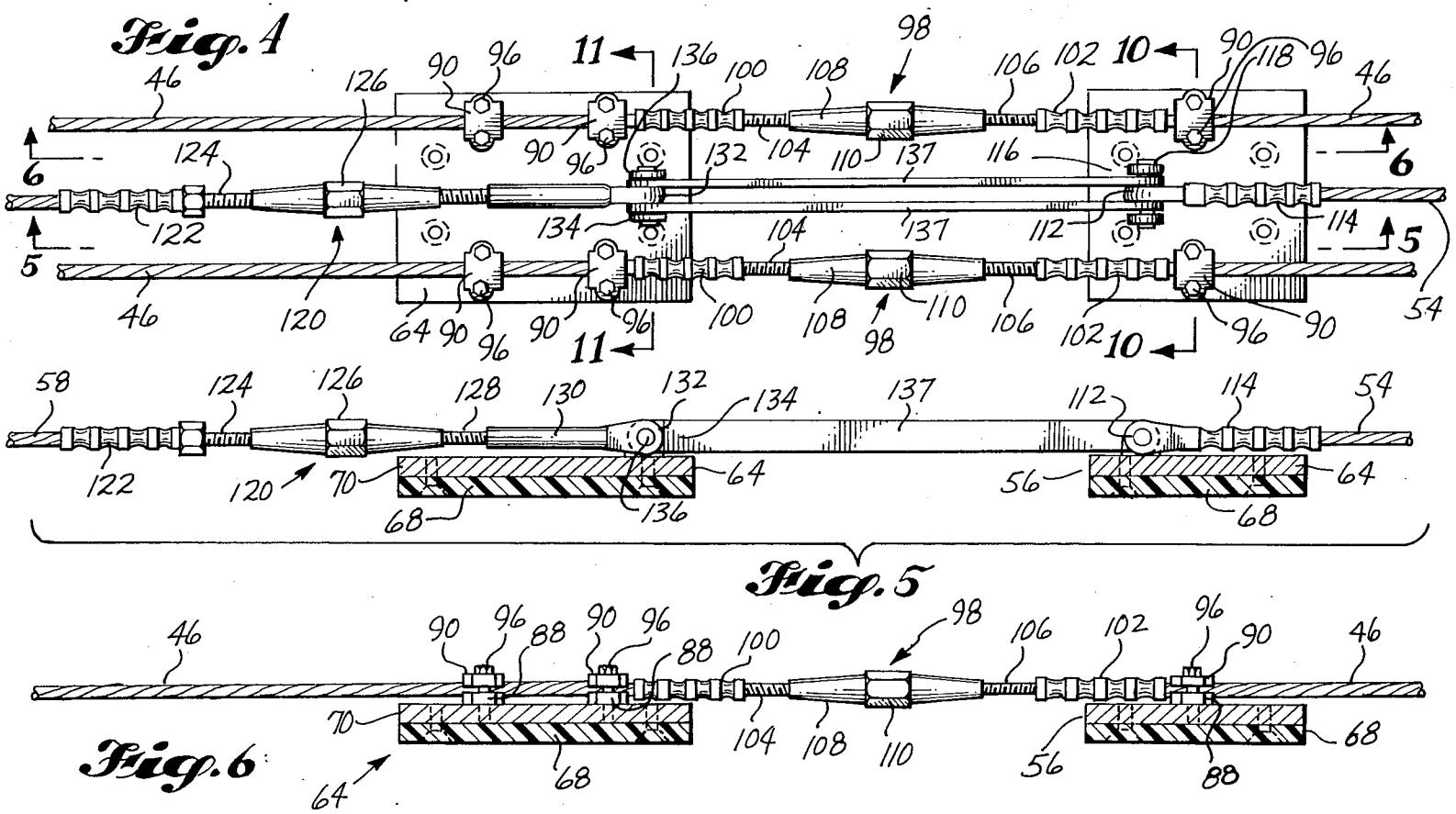
FIG. 4 is a plan view of a typical manner of connecting the cable members to the bearing pads and of adjusting tautness of the cable members.
FIG. 5 is a sectional view taken substantially along 5—5 of FIG. 4, with the background cable and its mounting means omitted, for clarity of illustration of the center cable and its mounting and tautness adjusting means.
FIG. 6 is a sectional view taken substantially along line 6—6 of FIG. 4.

Each support cable 46 is formed from a length of cable which is bent around on itself, with its two ends being connected together by a turnbuckle assembly. As shown by FIG. 4, each turnbuckle assembly 98 comprises a pair of opposite end members 100, 102 which are swaged to the end portions of the cable section, or are in some other manner firmly secured to the end portions of the cable section. One of the members 100, 102 includes a threaded portion 104 with right or left hand threads, and the other such member 100, 102 includes a threaded portion 106 having opposite hands thread. A turnbuckle nut 108 has end portions which mate with the threaded members 104, 106, and a central portion 110 which includes wrench flats. As is known per se, rotation of the member 108 in one direction, will cause the members 100, 102 to move endwise outwardly from member 108, and a reverse rotation will act to draw the members 100, 102 endwise towards member 108, putting tension in the cable 46 in the process.

Referring again to FIG. 4, an eye 112 is swage connected at 114 to the end portion of drive cable section 54 that is distal the winch drum 50. A connector pad 116, comprising a pair of spaced apart eyes, is secured to the metal plate portion of bearing pad 56. Eye member 112 is positioned between the two eyes of connector 116, and a bolt 118 is inserted through the three eyes, to connect the end of the cable section 54 to the bearing pad 56.

The connection of the drive cable sections 54, 58 to the winch drum 50 provides a way of adjusting tension in at least one of the drive cable sections 54, 56. The provision of a spring biased pully 62 provides some help in maintaining tension in drive cable section 58. A turnbuckle assembly 120 may also be installed in the drive cable section 58, to provide a way of adjusting tension. Referring to FIG. 5, one end portion 122 of the turnbuckle assembly 120 is swaged to the end of drive cable section 58 distal the winch drum 50. Turnbuckle end portion 122 includes a threaded rod 124 which makes threaded engagement with one end of a turnbuckle nut 26. The opposite end of the turnbuckle nut 126 makes threaded engagement with a threaded rod 128, of opposite hand threads. Threaded rod 128 is a part of a turnbuckle end piece 130 which includes an eye 132, by which it is connected to a two eye connector 134, by means of a fastener bolt 136. Turnbuckle 120 functions in the same manner as turnbuckles 98. That is, rotation of the nut 126 in one direction, shortens the cable 58, to increase tension, and rotation in the opposite direction lengthens the cable, to relieve tension.

In preferred form, a pair of structural links 137 extend between the connectors 116, 134. As shown by FIG. 4, one link 137 is on one side of the eyes 112, 132 and the second link 137 is on the opposite side of the eyes 112, 132. The bolts 118, 136 extend through end portions of the links 137.

As should be evident, the clamp assemblies 88, 90 associated with pad 64, must be loosened during periods of adjustment of turnbuckle 120. This is necessary so that the cable sections 46 can move relative to such clamp assemblies 88, 90 during adjustment of turnbuckle 120. After all of the cable sections 46, 54, 58 have been properly adjusted and tensioned, the clamp assemblies 88, 90 are tightened about the cable sections 46.

Figures 14, 15:
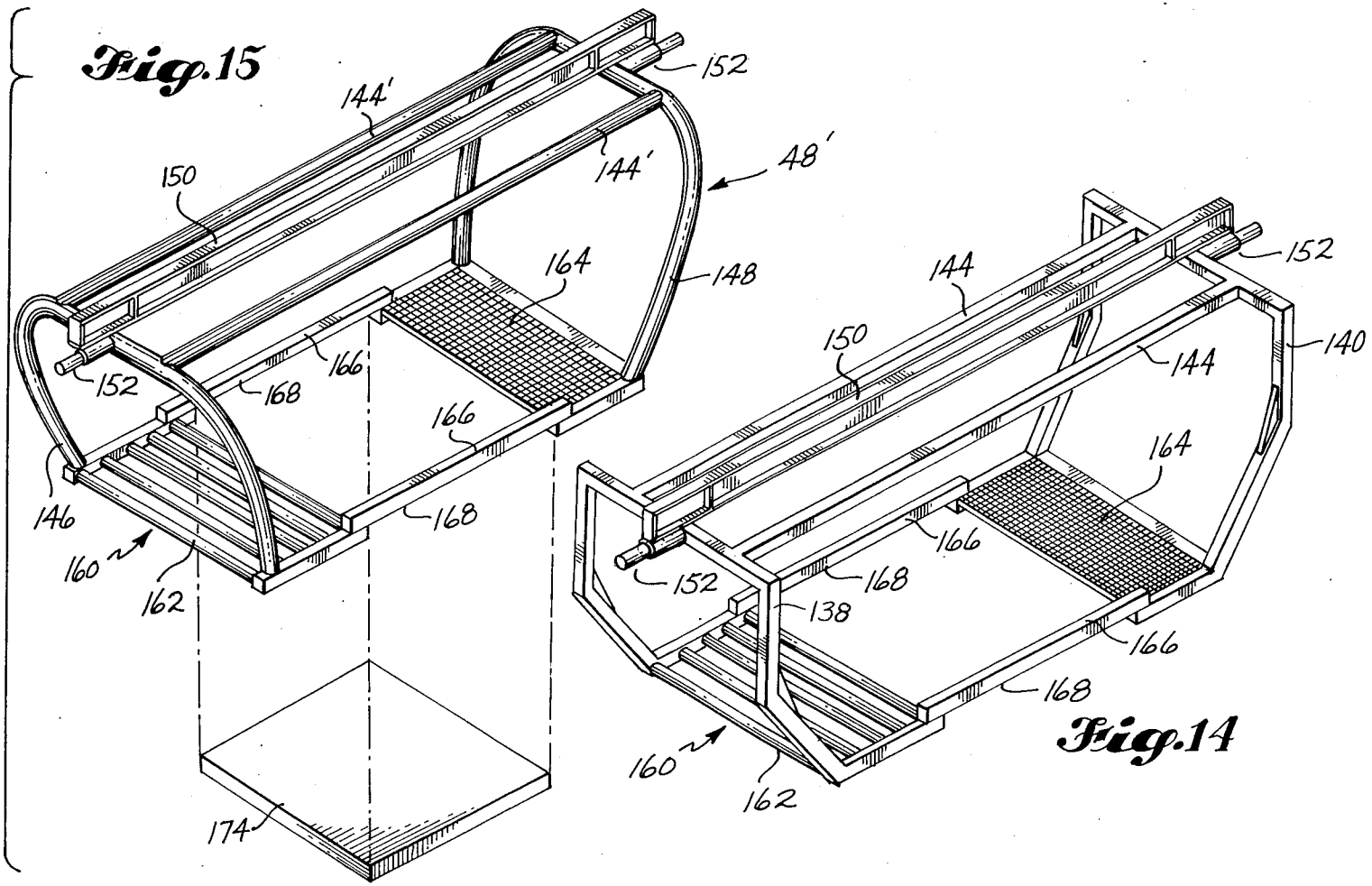
FIG. 14 is an isometric view of an embodiment of the article carrier, taken from above and looking towards one end and the side of the carrier.
FIG. 15 is a view like FIG. 14 but of a modified form of article carrier.

Referring to FIG. 14, an article carrier 48 of a type designed to receive an automobile sized vehicle, entering into the carrier from one of its ends, is shown to comprise a frame structure with end frame sections 138, 140, a bottom frame section 142, and a top frame section 144. The end frame sections 138, 140 are shown to jog inwardly as they extend downwardly. This is done to eliminate structure which if present might make interferring contact with an adjoining carrier 48, during use of the system.

The carrier 48' shown by FIG. 15 is basically similar to the carrier shown by FIG. 14, and is also adapted to receive an automobile sized vehicle via one of its ends. In this embodiment the end frame sections are in the nature of arches which slope inwardly as they extend downwardly. This again is done for the purpose of eliminating structure at the lower ends of the carrier 48' which if present might make contact with an adjacent carrier 48' during use of the system.

Carriers 48, 48' each includes a longitudinally extending top beam 150. Each beam 150 is centered laterally of its carrier 48, 48', and each carrier 48, 48' is symmetrically constructed about its beam 150, so that the forces of gravity will maintain the carrier 48, 48' substantially plumb.

A trunnion 152 is provided at each end of the beam 150. As shown by FIGS. 7 and 14, each trunnion 152 is adapted to be received within a tubular socket 154. The tubular socket 154 is connected to a member 156 which is in turn connected to a bearing pad member 66. As shown by FIG. 7, the member 156 may include an angle section 158 at its outer end. One leg of the angle section includes openings through which the bolts 96 extend before next extending through the cable clamp members 92, 88, and then threading into the metal body member 70 of the bearing pad 66. As also shown by FIG. 7, the trunnion 152 and mounting structure 154, 156 is oriented to place the trunnion axis 160 at a common level with the support cables 46. As should be evident, the trunnion 152 losely fits within the socket member 154, so that relative rotation can easily occur between the trunnion 152 and the socket member 154. Thus, as the position of the members 154, 156 changes, in response to their moving along with the cable 46 to which member 158 is clamped, the carrier 48 or 48' can continuously adjust itself to remain in a plumb position.

In preferred form, end loading carriers of the type shown by FIGS. 14 and 15 are provided with reduced weight floor sections. A first section 160 is formed from a plurality of spaced apart tube members 162. The tube members 162 extend laterally of the carrier and its support beam 150. The wheels at a first end of the vehicle are cradled between a pair of these tubes 162. This cradling of the wheels acts to prevent unwanted rolling movement of the vehicle back and forth while in the carrier 48, 48', or possibly out through one end of the carrier 48, 48'. The opposite end of the carrier 48, 48' includes a second floor section 164 which supports the wheels of the vehicle at such end.

The floor sections 162, 164 are connected together by beams 166 which have lower surfaces 168 spaced vertically above the bottom surfaces 170, 172 of the floor end section 160, 164. As shown in FIGS. 2 and 15, a platform 174 is provided on the base 14 at such a location that when a carrier 48, 48' is at its lowermost position in the system the platform 174 occupies the space between the two floor sections 160, 164, and its upper surface is substantially level with the floor sections 160, 162. Thus, when the carrier 48, 48' is in its lowermost position, a motor vehicle can be driven onto or off from the carrier 48, 48' and its wheels will run on a substantially constant level, provided by the end section 160, the platform 174 and the floor section 164.

Floor section 164 may be constructed from grating for the purpose of reducing its weight.

A plurality of tubes 162 are used in floor section 160, to provide a plurality of wheel cradles. This makes it possible to substantially center different length vehicles on the carrier 48, 48'.

Figure 16:
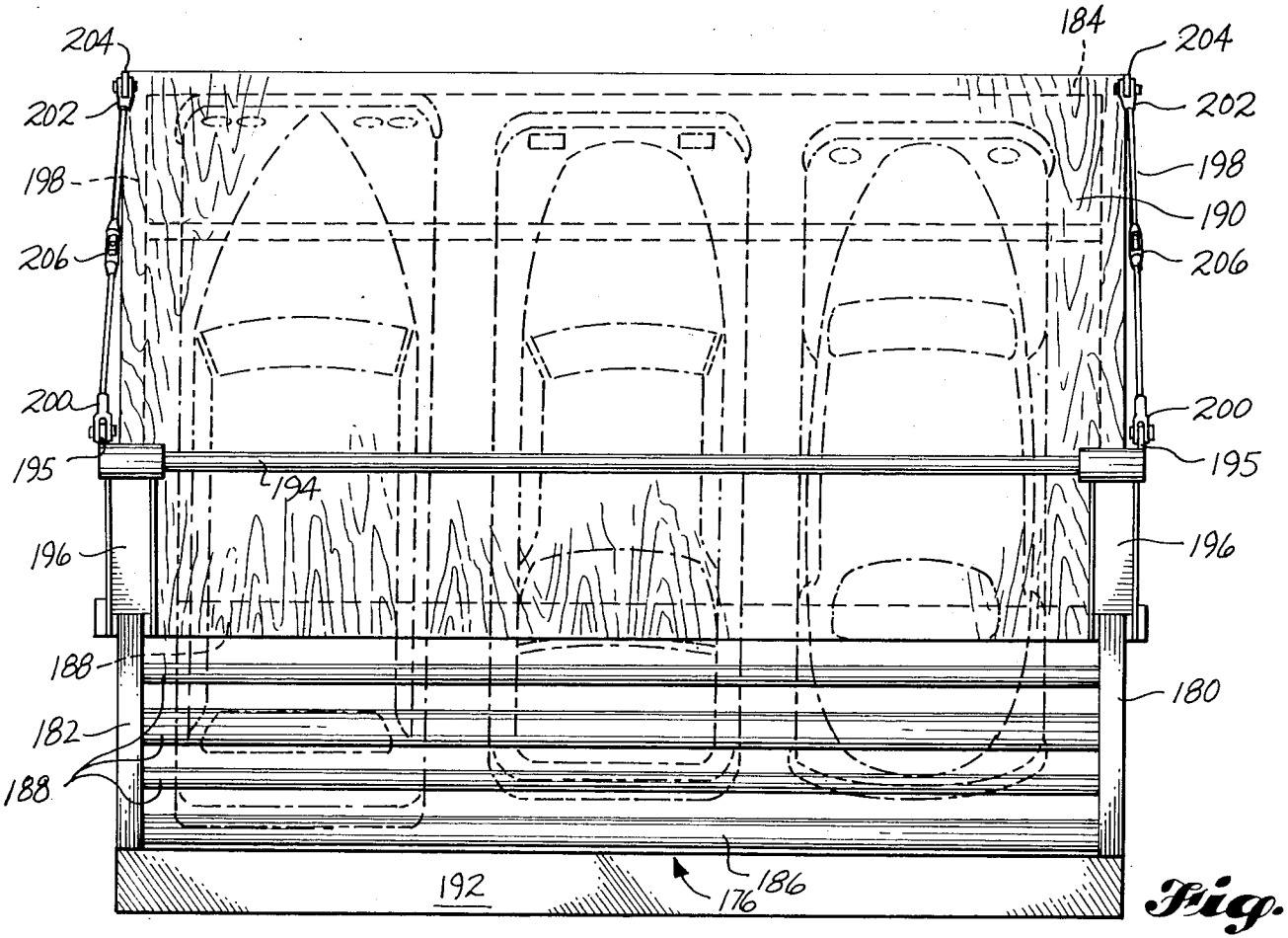
FIG. 16 is an end elevational view of another form of article carrier.
Figure 17:
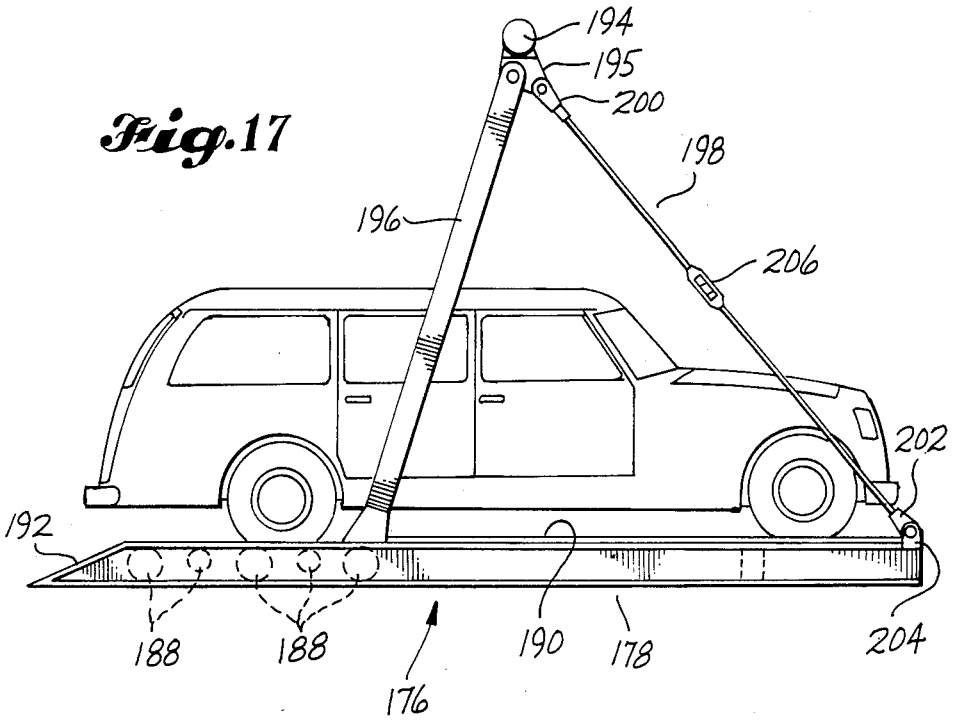
FIG. 17 is a top plan view of the carrier shown by FIG. 16.

FIGS. 16 and 17 show a different form of article carrier 176. This article carrier 176 is adapted to receive a plurality of vehicles entering onto the carrier 176 from a direction perpendicular to the suspension axis of the carrier. When this type of carrier is utilized, a lower set of the crossing brace members 24 (FIG. 2) is eliminated from the frame 10, and the frame 10 is suitably braced in some other manner. The frame members 24 are eliminated so that room exists for vehicles to move onto and off from the carrier 176 from the side shown in the foreground in FIG. 2.

Carrier 176 may comprise a base 178 composed of end beams 180, 182, side beams 184, 186, wheel cradling tubes 188 at one side, and decking 190 extending over the region of the base 178 which does not include the wheel cradling tubes 188. The decking may be made from 1 and 1/4 inch thick plywood.

Base 178 preferably includes a ramp 192 situated outwardly of the wheel cradling tubes 188, for guiding the vehicle wheels onto and off of the carrier base 178. Carrier 176 is supported in the same manner as carriers 48, 48'. It includes an upper transverse beam 194 having trunnions at its ends (not shown) like trunnions 152, (FIGS. 7, 14 and 15). The trunnions may be connected to the support cables (46) in the same manner as shown by FIG. 7.

At each end of the carrier 176, there is provided a rigid strut 196 which is connected at its lower end to a beam 180, 182 and at its upper end to one end of the transverse suspension beam 194. At each end of carrier 196 there is also a second structural link 198 which may be a length of cable having an eye 200, 202, at each of its ends. The eye 200 is connected to a support bracket which depends down from beam 194. The eye 202 is connected to a fitting 204 provided at a corner of the base 178. The links 198 preferably include a turnbuckle 206, providing a way of adjusting the attitude of the base 196, so that it can be maintained substantially level.

The ends of the strut 196 are pin connected to the base 178 and the support beam 194, and the ends 200, 202 of the member 198 are pin connected to the bracket 195 and the mounts 204.

The use of cables instead of chains for moving the article carriers produces several important advantages. Cable is cheaper than chain and is stronger and more reliable as a structural member under load. Chain requires the use of sprocket wheels and lubrication on an ongoing basis. This increases the operating expenses and also results in a dirty environment around the equipment. Also, a chain and sprocket drive system is relatively noisy.

Various features of the present invention can be utilized in systems which differ substantially from the illustrated system. For example, additional wheels may be provided for the purpose of changing the shape of the travel path of the support cable 46. In some installations, the wheels may be replaced by another type of guide system for the support cables. Also, the support cable system can be used, but with a different type of drive. The frame structure might be buried in the ground, with the movement onto and off from the carriers occuring at an elevated level. Also, the system can be used for storing articles other than automobile size motor vehicles. For example, it can be used for storing boats and storage containers. Accordingly, I am not to be limited by the details which have been illustrated and described, but rather only by the following claims, interpreted in accordance with established rules of claim interpretation, including the doctrine of equivalents.

What is claimed is:

1. An article storage system, comprising:

an endless support cable;

means supporting and guiding the endless cable for endless travel within a plane, between different vertical levels;

article carrier means secured to said endless support cable;

a drive drum spaced from said endless support cable and located substantially within the same plane as said endless support cable;

reversible drive means for said drive drum;

a first drive cable section having a first end connected to said drive drum, said first drive cable section extending in a first direction from said drive drum to the endless support cable, said first drive cable section having a second end that is connected to the endless support cable;

a second drive cable section having a first end connected to the drive drum, said second drive cable section extending from the drive drum to the endless support cable in the opposite direction from the first drive cable section, said second drive cable section having a second end connected to the endless support cable; and wherein the two drive cable sections are connected to the endless support cable at locations such that rotation of the drive drum in one direction will wrap the first drive cable section onto the drive drum, in such a way that the first drive cable section will pull on the endless support cable and move it and the article carrier in one direction around said means for supporting and guiding the endless support cable in a first direction, and at the same time the second drive cable section will be unwrapped from the drive drum, and a reverse rotation of the drive drum will cause the second drive cable section to be wrapped onto the drive drum, causing said second drive cable section to pull on the endless support cable to move it and the article supporting carrier means in a reverse direction, while at the same time unwrapping the first drive cable section from the drive drum.

2. An article storage system according to claim 1, wherein said endless support cable includes a plurality of bearing pads spaced apart along its length, said bearing pads including low friction material which makes contact with said means for supporting and guiding the endless support cable.

3. An article storage system according to claim 1, wherein said endless support cable includes turnbuckle means for adjusting the tension in the endless support cable.

4. An article storage system according to claim 1, comprising a second endless support cable, said endless support cables being substantially identical and being positioned substantially side by side, to travel about said means for supporting and guiding the support cable, and both of said cables being connected to the article carriers.

5. An article storage system according to claim 4, wherein each drive cable section connects to the endless two support cables at a location between the two support cables.

6. An article storage system according to claim 1, wherein said means for supporting and guiding the endless support cable has a radially outwardly opening channel portion into which said support cable is received.

7. An article storage system according to claim 6, comprising a second endless support cable, said endless support cables extending in a side-by-side relationship, both of said endless support cables being connected to bearing pad members which ride in said channel portion.

8. An article storage system according to claim 6, wherein each drive cable section connects to the two endless support cables at a location between the two support cables.

9. An article storage system according to claim 7 wherein each bearing pad member includes a layer of low friction material on its side which makes contact with a base surface of the channel portion.

10. An article storage system, comprising:

a first wheel mounted for rotation about a first horizontal axis;

a second wheel mounted for rotation about a second horizontal axis;

said first and second wheels being spaced apart within a common plane;

an endless support cable extending about both wheels, said cable including a plurality of spaced apart bearing pad members positioned to make contact with the wheels upon movement of the support cable relative to the wheels;

a plurality of article holding carriers spaced around the endless support cable, each said carrier including means connecting it to a said bearing pad member;

a drive drum spaced from both wheels, said drive drum being located substantially in the same plane as said wheels;

reversible drive means for the drive drum;

a first drive cable section having a first end connected to said drive drum, said first drive cable section extending in a first direction from said drive drum to the endless support cable, said first drive cable section having a second end that is connected to the endless support cable;

a second drive cable section having a first end a second drive cable section having a first end connected to the drive drum, said second drive cable section extending from the drive drum to the endless support cable in the opposite direction from the first drive cable section, said second drive cable section having a second end connected to the endless support cable; and wherein the two drive cable sections are connected to the endless support cable at locations such that rotation of the drive drum in one direction will wrap the first drive cable section onto the drive drum, and such first drive cable section will pull on the endless support cable and will move it and the article holding carriers around the wheels in a first direction, and at the same time the second drive cable section will be unwrapped from the drive drum, and a reverse rotation of the drive drum will cause the second drive cable section to be wrapped onto the drive drum, causing such second drive cable section to pull on the endless support cable to move it and the article supporting carriers in a reverse direction, and at the same time the first drive cable section will be unwrapped from the drive drum.

11. An article storage system according to claim 10, wherein the endless support cable includes turnbuckle means for adjusting the tension in the support cable.

12. An article storage system according to claim 10, comprising a second endless support cable, said endless support cables extending about the first and second wheels, in a side-by-side relationship, both of said endless support cables being connected to the bearing pad members.

13. An article storage system according to claim 12, wherein each drive cable section connects to the two endless support cables at a location between the two endless support cables.

14. An article storage system according to claim 10, wherein each bearing pad member includes a layer of low friction material on its side which makes contact with the wheels.

15. An article storage system according to claim 14, comprising a second endless support cable, said endless support cables extending about the first and second wheels, in a side-by-side relationship, both of said endless support cables being connected to the bearing pad members.

16. An article storage system according to claim 15, wherein each drive cable section connects to the two endless support cables at a location between the two endless support cables.

17. An article storage system according to claim 10, wherein each wheel has a radially outwardly opening channel portion into which said endless support cable is received.

18. An article storage system according to claim 17, comprising a pair of endless support cables extending about the first and second wheels, in a side-by-side relationship, both of said endless support cables being connected to the bearing pad members.

19. An article storage system according to claim 17, wherein each drive cable section connects to the two endless support cables at a location between the two endless support cables.

20. An article storage system according to claim 17, wherein each bearing pad member includes a layer of low friction material on its side which makes contact with the wheels.

21. An article storage system according to claim 20, comprising a second endless support cable, said endless support cables extending about the first and second wheels, in a side-by-side relationship, both of said endless support cables being connected to the bearing pad members.

22. An article storage system according to claim 21, wherein each drive cable section connects to the two endless support cables at a location between the two endless support cables.

23. An article storage system comprising:

a pair of axially spaced apart first wheels mounted for rotation about a first horizontal axis;

a pair of axially spaced apart second wheels mounted for rotation about a second horizontal axis;

said first wheels being spaced vertically above the second wheels, with each said first wheel being located in a common plane with a said second wheel below it;

a first endless support cable extending about a first of the first wheels and about the second wheel located below it;

a second endless support cable extending about the second first wheel and about the second wheel located below it;

each said endless support cable including a plurality of spaced apart bearing pad members positioned to make contact with the wheels upon movement of the endless support cable relative to the wheels;

a plurality of article holding carriers spaced around the endless support cables, and laterally between the wheels, each said carrier including means at its opposite ends connecting it to bearing pad members carried by the endless support cables;

at least one drive drum spaced from a said second wheel, said drive drum being substantially located in the same plane as both such second wheel and the first wheel located above it;

reversible drive means for the drive drum;

a first drive cable section having a first end connected to said drive drum, said first drive cable section extending in a first direction from said drive drum to the endless support cable on said first and second wheels, in a common plane with the drive drum, said first drive cable section having a second end that is connected to said endless support cable;

a second drive cable section having a first end connected to the drive drum, said drive cable section extending from the drive drum to the endless support cable in the opposite direction from the first drive cable section, said second drive cable having a second end connected to said endless support cable; and wherein the two drive cable sections are connected to said endless support cable such that rotation of the drive drum in one direction will wrap the first drive cable section onto the drive drum, and such first drive cable section will pull on the support cable and move it and the article holding carrier around the wheels in a first direction, and at the same time the second drive cable section will be unwrapped from the drive drum, and a reverse rotation of the drive drum will cause the second drive cable section to be wrapped onto the drive drum, causing said second drive cable section to pull on the endless support cable to move it and the article supporting carrier in a reverse direction, while at the same time unwrapping the first drive cable section from the drive drum.

24. An article storage system according to claim 23, comprising a second drive drum, a reversible drive means for said second drive drum, a first drive cable section and a second drive cable section, connected to the second drive drum and to the endless support cable on the other pair of first and second wheels in the same manner that the first and second drive cable sections of the first drive drum are connected to such drive drum and to the endless support cable on its side of the article storage system.

25. An article storage system according to claim 23, wherein each bearing pad member includes a low friction surface directed to contact the wheels.

26. An article storage system, comprising:

endless cable means;

means supporting and guiding the endless cable means for axial travel between different vertical levels;

antifriction means attached to said endless cable means and making sliding contact with said means supporting article carrier means secured to said endless cable means; and line means connected to the endless cable means for moving the endless cable means on said means for supporting and guiding, to in that manner move the article carrier means in position.

27. An article storage system comprising:

a pair of axially spaced apart first wheels mounted for rotation about a first horizontal axis;

a pair of axially spaced apart second wheels mounted for rotation about a second horizontal axis;

said first wheels being spaced vertically above the second wheels, with each said first wheel being located in a common plane with a said second wheel below it;

a first endless support cable means extending about a first of the first wheels and about the second wheel located below it;

a second endless support cable means extending about the second first wheel and about the second wheel located below it;

each said endless support cable means including a plurality of spaced apart bearing pad members positioned to make sliding contact with the wheels upon movement of the support cable means relative to the wheels;

a plurality of article holding carriers spaced around the support cable means, and laterally between the wheels, each said carrier including means at its opposite ends connecting it to bearing pad members carried by the support cables; and reversible drive means connected to the endless cable means for moving the endless cable means on said wheels, to in that manner move the article holding carrier means in position.

* * * * *

UNITED STATES PATENT AND TRADEMARK OFFICE
CERTIFICATE OF CORRECTION

PATENT NO. : 4,674,602

DATED : June 23, 1987

INVENTOR(S) : Wayne D. Smith and Bradley C. Smith

It is certified that error appears in the above-identified patent and that said Letters Patent are hereby corrected as shown below:

On the title page under "References Cited", add

| | | |
|---|---|---|
| 1,834,385 | 12/1931 | Currie |
| 1,867,675 | 7/1932 | McHenry et al. |
| 2,738,885 | 3/1956 | Demaline |
| 2,787,387 | 4/1957 | Scott |
| 2,792,105 | 5/1957 | Wilson |
| 2,817,446 | 12/1957 | Hodous |
| 2,838,187 | 6/1958 | Schulte |
| 3,153,488 | 10/1964 | Mori |
| 3,269,569 | 8/1966 | Brauner |

Column 1, line 58, "stoarge" should be -- storage --.

Claim 5, column 10, lines 55 and 56, "endless two support" should be -- two endless support --.

Signed and Sealed this

Sixteenth Day of February, 1988

*Attest:*

DONALD J. QUIGG

*Attesting Officer*

*Commissioner of Patents and Trademarks*